US008033260B2

(12) United States Patent
Reinecke-Murmann et al.

(10) Patent No.: US 8,033,260 B2
(45) Date of Patent: Oct. 11, 2011

(54) VALVE LEVER ASSEMBLY HAVING A SWITCHABLE VALVE ACTUATING MECHANISM

(75) Inventors: Joachim Reinecke-Murmann, Aachen (DE); Rüdiger Erz, Baesweiler (DE); Dirk Kirby, Stolberg (DE)

(73) Assignee: META Motoren- und Energie- Technik GmbH, Herzogenrath (DE)

( * ) Notice: Subject to any disclaimer, the term of this patent is extended or adjusted under 35 U.S.C. 154(b) by 448 days.

(21) Appl. No.: 12/365,941

(22) Filed: Feb. 5, 2009

(65) Prior Publication Data

US 2009/0199800 A1 Aug. 13, 2009

Related U.S. Application Data

(60) Provisional application No. 61/026,901, filed on Feb. 7, 2008.

(51) Int. Cl.
*F01L 1/18* (2006.01)

(52) U.S. Cl. ..... 123/90.39; 123/90.16; 74/569

(58) Field of Classification Search ..... 123/90.16, 123/90.39; 74/569
See application file for complete search history.

(56) References Cited

U.S. PATENT DOCUMENTS

| | | | | |
|---|---|---|---|---|
| 6,848,402 | B2 * | 2/2005 | Kreuter | 123/90.16 |
| 6,923,151 | B2 | 8/2005 | Kreuter | |
| 6,966,291 | B1 | 11/2005 | Fischer | |
| 7,328,675 | B2 | 2/2008 | Seitz | |
| 2010/0162979 | A1 | 7/2010 | Kreuter | |

FOREIGN PATENT DOCUMENTS

| | | | |
|---|---|---|---|
| DE | 10227870 | A1 | 1/2004 |
| DE | 10 2005 039 368 | A1 | 2/2007 |
| EP | 0 995 885 | A2 | 4/2000 |
| JP | 03 033414 | A | 2/1991 |

* cited by examiner

*Primary Examiner* — Zelalem Eshete
(74) *Attorney, Agent, or Firm* — Muncy, Geissler, Olds & Lowe, PLLC

(57) ABSTRACT

A valve lever assembly having a switchable valve actuating mechanism comprises a first follower surface for following a first cam, at least one second follower surface for following a second cam and a valve lever, which is supported on an engine-affixed component and on the to-be-actuated valve, wherein the second follower surface is rotatable relative to the first follower surface by a lockable eccentric device borne on the valve lever and the eccentric device comprises an eccentric opening, which penetrates transversely through the valve lever and is fixed relative to the valve lever to as to rotate therewith, and an eccentric shaft rotatably borne in the eccentric opening, the eccentric shaft defining the position of the second follower surface.

18 Claims, 6 Drawing Sheets

VALVE LEVER ASSEMBLY HAVING A SWITCHABLE VALVE ACTUATING MECHANISM

CROSS-REFERENCE

This application is a U.S. non-provisional application claiming the benefit under 35 U.S.C. §119 (e)(1) to U.S. provisional application 61/026,901, having a filing date of Feb. 7, 2008. This application is also related to German application DE 10 2008 008 094.2-13.

TECHNICAL FIELD

The invention concerns a valve lever assembly having a switchable valve actuating mechanism, as is used, e.g., in reciprocating-piston, internal combustion engines, for changing the engine valve timing of an intake valve.

BACKGROUND

Switchable valve actuating mechanisms are utilized in many ways and serve to adapt the engine valve timing to different operating conditions in order to favorably influence the power development, the torque performance and the exhaust gas properties of the internal combustion engine.

A valve lever assembly having a switchable valve actuating mechanism for acting in combination with a camshaft having a first cam and second cam, which second cam is higher than the first cam is known from DE 10 2005 039 368 A1. In this valve lever assembly, the eccentric device includes an eccentric body rotatably borne in the valve lever; bearing pins disposed in the valve lever eccentrically to its bearing axis project from both sides of the eccentric body; follower rollers, each for following a respective second cam, are borne on the eccentric pins. The pivotability of the eccentric body relative to the valve lever is lockable by means of a connection lever that is connected with the eccentric body so as to rotate therewith.

The object underlying the invention is to simplify the construction and assembly of a conventional valve lever assembly.

SUMMARY

This object is achieved with a valve lever assembly having a switchable valve actuating mechanism for acting in combination with a camshaft having a first cam and at least one second cam, which is higher than the first cam, which valve assembly comprises a first follower surface for following the first cam, at least one second follower surface for following the second cam and a valve lever, which is supported on an engine-affixed component and on the to-be-actuated valve, wherein the second follower surface is rotatable relative to the first follower surface by an eccentric device borne on the valve lever, and a locking mechanism, with which the rotatability of the eccentric device is lockable, wherein when the eccentric device is freely rotatable, the first follower surface actuates the valve in accordance with the contour of the first cam and when the rotatability of the eccentric shaft is locked, the second follower surface actuates the valve in accordance with the contour of the second cam, and wherein the eccentric device comprises an eccentric opening, which penetrates transversely through the valve lever and is fixed relative to the valve lever to as to rotate therewith, and an eccentric shaft rotatably borne in the eccentric opening, the eccentric shaft defining the position of the second follower surface.

According to a second aspect of the invention, the eccentric opening has a cross-sectional profile with a concave bearing segment that is opposite to a concave guide segment, which is less sharply curved than the bearing segment, and the eccentric shaft includes a bearing portion in a bearing part of the eccentric shaft, which eccentric shaft is accommodated in the eccentric opening, the outer contour of the bearing portion being adapted to that of the bearing segment, and the eccentric shaft also includes a guide portion, whose outer contour is adapted to the guide segment so that the eccentric shaft is reciprocally rotatable in the eccentric opening while rotating in the bearing segment and while being guided along the guide segment.

According to third aspect of the invention, the bearing segment includes a first circular segment having a first curvature of radius and the guide segment includes a second circular segment having a second curvature of radius, which is larger than the first curvature of radius, and the two circular segments have a common curvature center point, through which the eccentric shaft extends.

According to a fourth aspect of the invention the cross-sectional profile of the bearing portion includes a portion corresponding to the first circular segment.

According to a fifth aspect of the invention the cross-sectional profile of the guide portion includes a portion corresponding to the second circular segment.

According to a sixth aspect of the invention an abutment segment is formed in a transition segment between the guide segment and the bearing segment, the abutment segment limiting the rotatability of the eccentric shaft.

According to a seventh aspect of the invention a segment of the eccentric opening that is opposite to the abutment segment widens as an insertion segment such that the eccentric shaft is slidable into the eccentric opening in a rotational position relative to the eccentric opening, in which the bearing portion is facing towards the abutment segment, and from this rotational position is rotatable into a rotational position, in which the bearing portion is accommodated in the bearing segment and the guide portion comes into abutment on the guide segment.

According to an eight aspect of the invention the eccentric opening is formed in an eccentric bearing body disposed in the valve lever so as to rotate therewith.

According to a ninth aspect of the invention the first follower surface is formed by the circumferential surface of a follower roller borne on the eccentric bearing body.

According to a tenth aspect of the invention the eccentric shaft includes a pin defining the position of the second follower component axially adjacent to the bearing of the eccentric shaft in the eccentric opening, the eccentric shaft being elastically biased in the direction of abutment of the second follower surface on the second cam and being lockable by the locking mechanism when the second follower surface abuts on the base circle of the second cam.

According to an eleventh aspect of the invention the second follower surface is formed by the circumferential surface of a follower roller borne on the pin.

According to a twelfth aspect of the invention the locking mechanism includes a connecting lever connected with the eccentric shaft so as to rotate therewith, the position of the connecting lever being lockable relative to the valve lever when the second follower surface abuts on the base circle of the second cam.

According to a thirteenth aspect of the invention the eccentric shaft is integrally formed with the connecting lever and the pin.

According to a fourteenth aspect of the invention a locking component is mounted on the valve lever, the locking component being reciprocally movable between a position locking the rotatability of the connecting lever and a position permitting the pivotability.

According to a fifteenth aspect of the invention the locking component is formed as a locking pin, which is displaceable by hydraulic pressure against the force of a spring.

According to a sixteenth aspect of the invention a spring lever is borne on the valve lever, which spring lever is in engagement with the eccentric shaft and is biased by a spring supported between the valve lever and the spring lever such that the second follower surface is biased in the direction of abutment on the second cam.

According to a seventeenth aspect of the invention a second follower surface is formed on both sides of the bearing of the eccentric shaft in the eccentric opening, the respective second follower surfaces acting in combination with the respective second cams.

According to an eighteenth aspect of the invention the engine-affixed component, on which the valve lever is supported, is formed as a hydraulic valve play-compensation element, through which the locking mechanism is actuatable by hydraulic pressure.

The aspects of the invention as mentioned above may be combined in different manners. E.g. the fifth aspect may be combined with the third or the fourth aspect; the sixth aspect may be combined with any of the second to fifth aspect; the eighth aspect may be combined with any of the preceding aspects; the tenth aspect may be combined with any of the preceding aspects; the twelfth aspect may be combined with any of the preceding aspects; the sixteenth to eighteenth aspect may also be combined with any of the preceding aspects.

The invention, which can be utilized for substantially all types of cam shafts and allows a switching between two different opening curves, of which one can be a neutral actuation, will be described in an exemplary manner in the following with the assistance of schematic drawings and with further details.

DETAILED DESCRIPTION

Figure 1:
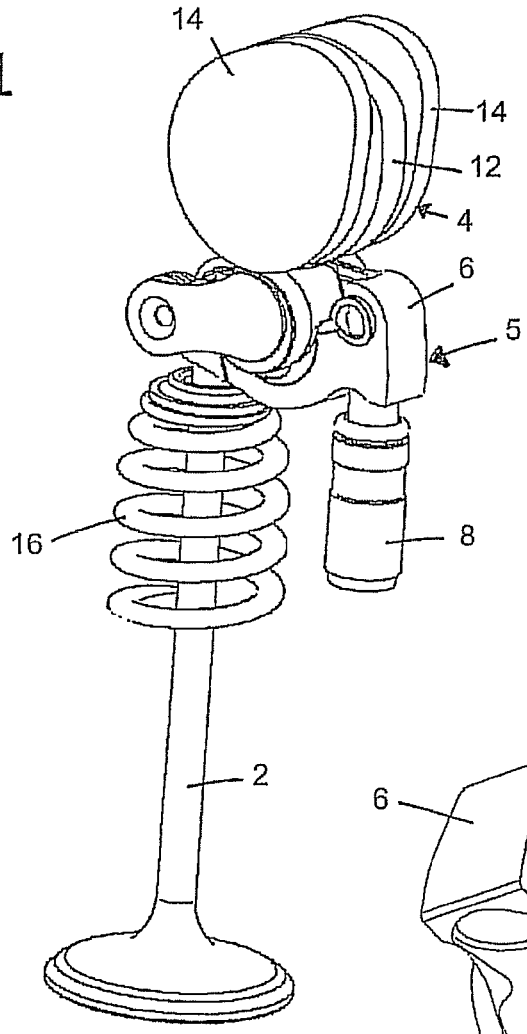
FIG. 1 shows an overall view of a valve drive having an inventive valve lever assembly.

In accordance with FIG. 1, a charge changing valve 2, e.g., an intake valve of an internal combustion engine, is actuated by a cam shaft 4 by disposing between them a valve lever assembly, which is denoted as a whole with 5, having a valve lever 6. One end of the valve lever 6 is supported on a known hydraulic valve play-compensation element 8 and the other end is supported on the shaft of the valve 2 and the valve lever 6 abuts on cams 12 and 14, respectively, of the cam shaft 4 between its ends in a manner that will be further described below. As is apparent, a middle first cam 12 is designed with a smaller elevation than the side second cams 14. A valve closing spring is denoted with 16. The hydraulic valve play-compensation element 8 causes the valve lever 6 to contact at least one of the cams and the shaft of the valve without play.

Figure 2:
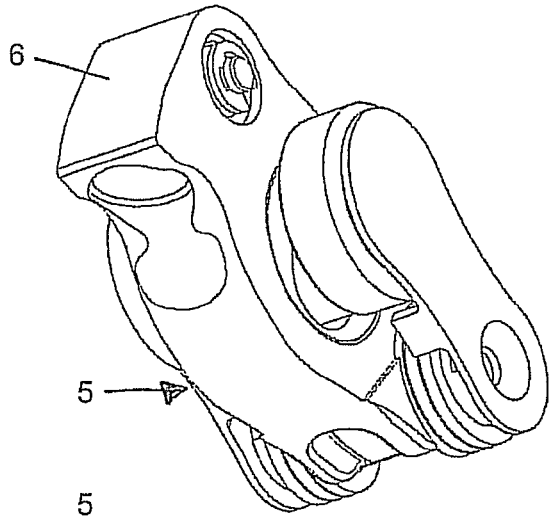
FIGS. 2-3 show different perspective views of the valve lever assembly of FIG. 1.

FIG. 2 shows the valve lever assembly 5 obliquely from below and with the end of the valve lever 6, which is supported on the valve play-compensation element 8, facing the observer.

Figure 3:
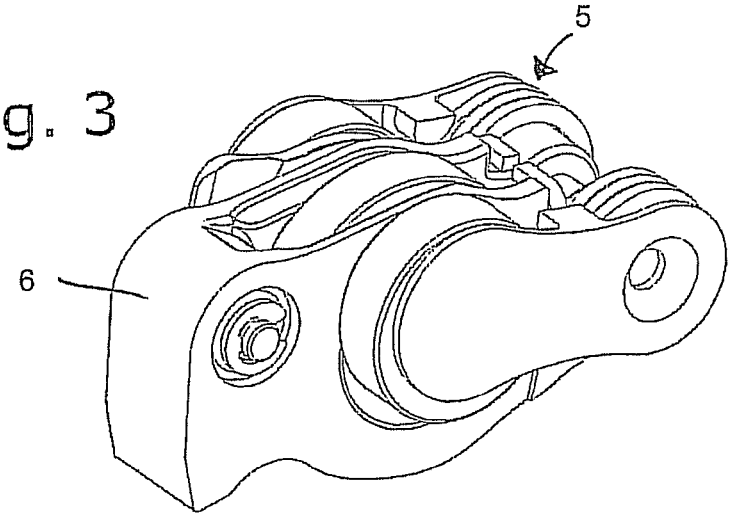

FIG. 3 shows the valve lever assembly 5 in a perspective illustration obliquely from above.

For the purpose of clarity, the individual parts of the valve lever assembly are not provided with reference numbers in FIGS. 1-3.

Figure 4:
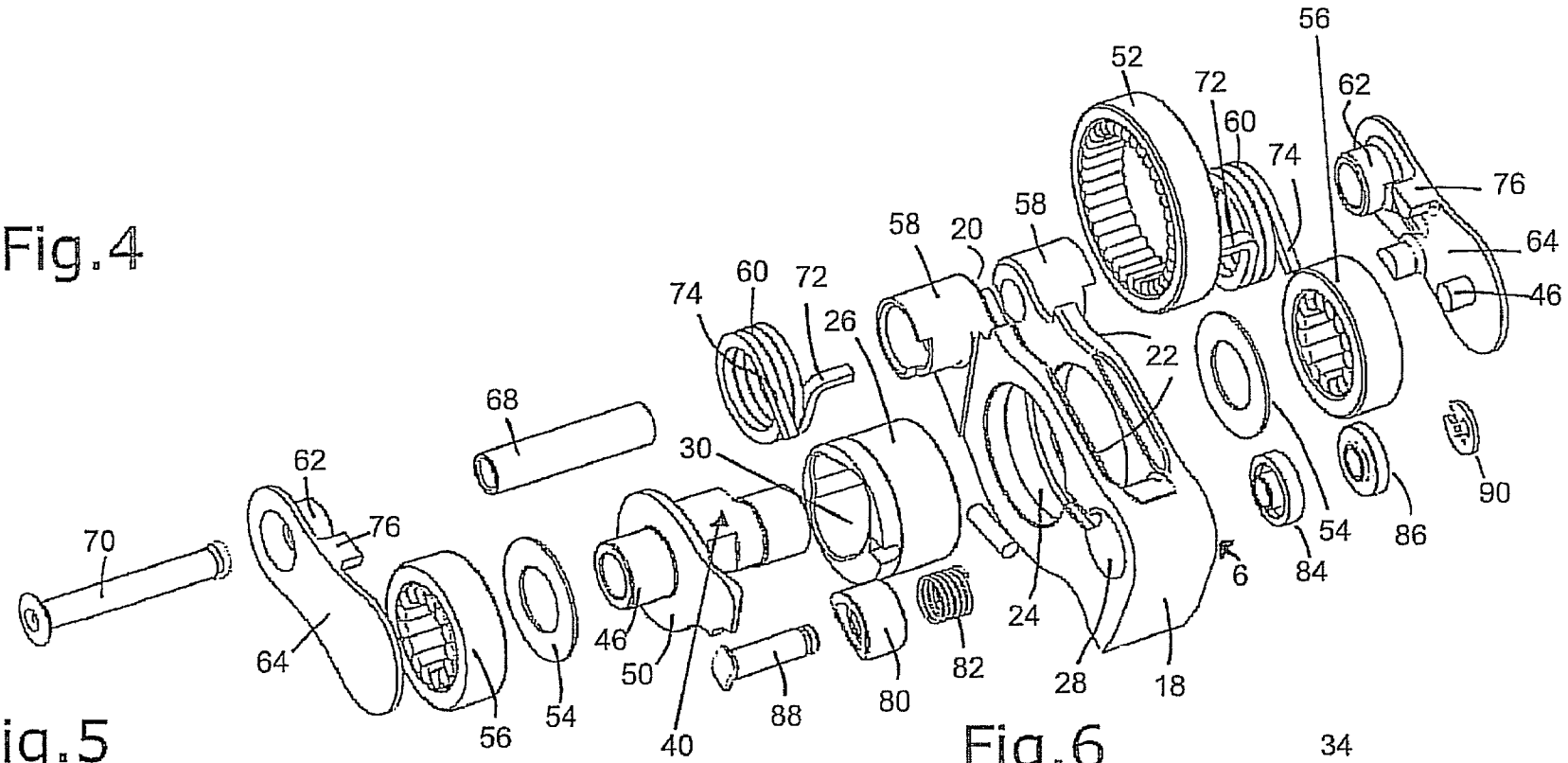
FIG. 4 shows the valve actuating mechanism according to FIGS. 1-3 in an exploded illustration.

FIG. 4 shows the valve lever assembly according to FIG. 1 with its individual parts in exploded illustration:

The valve lever 6 has two end portions 18 and 20 that are connected with each other via spaced-apart side parts 22. As is apparent from FIG. 2, the under side of the valve lever 6 is advantageously closed. An opening 24 extends transversely through the side parts 22; an eccentric bearing body 26 is insertable in the opening 24. The end portion 28, which lies on the valve play-compensation element 8, is hollow in the interior and has a passage opening 28.

Figure 6:
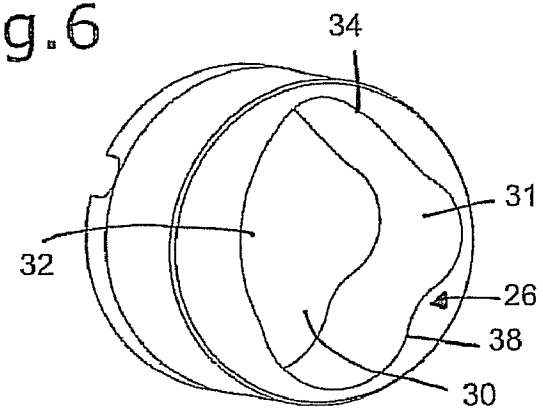
FIG. 6 shows a perspective illustration of the eccentric bearing body.
Figure 5:
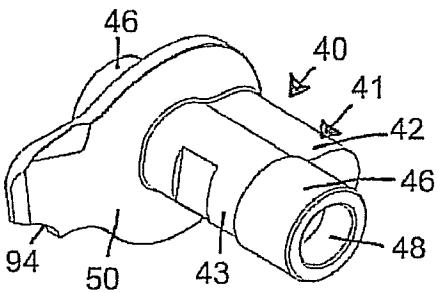
FIG. 5 shows a perspective illustration of the cam shaft.
Figure 7:
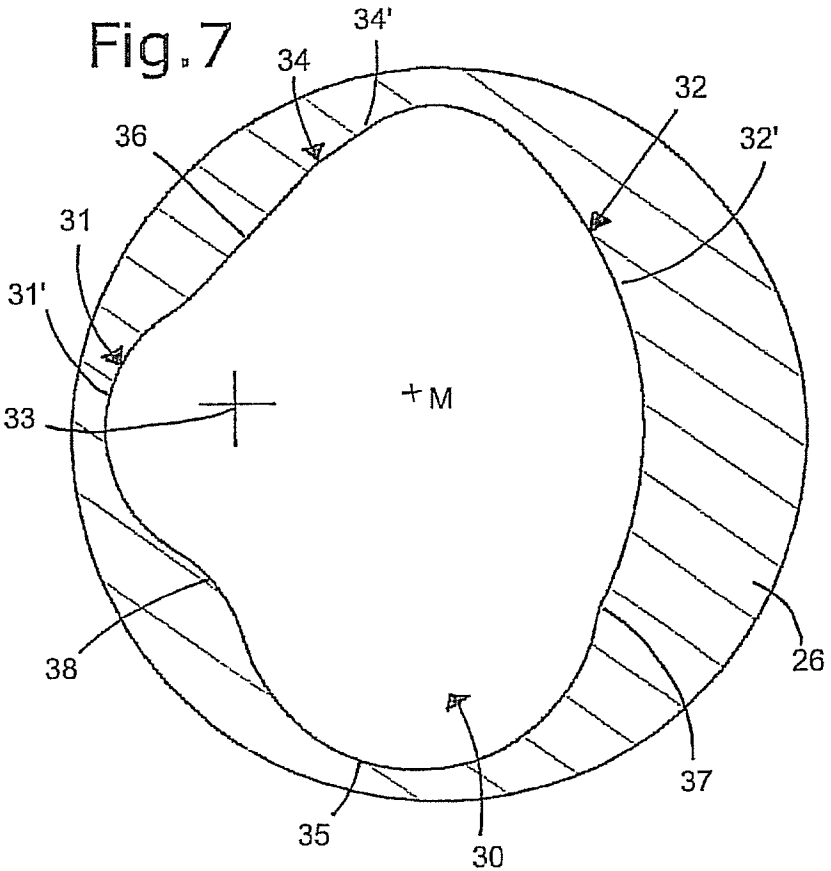
FIG. 7 shows a side view of the eccentric bearing body.

The eccentric bearing body 26 is provided with an eccentric opening 30 penetrating transversely therethrough, whose cross-section will be explained in more detail with the assistance of FIGS. 6 and 7.

The eccentric opening 30, whose cross-section as a whole approximately has the shape of a kidney with a bulge, comprises a concave bearing segment 31 and a concave guide segment 32 opposing the bearing segment 31, wherein the curvature of the guide segment 32 is less sharp than the curvature of the bearing segment 31. The bearing segment 31 comprises a first circular segment 31' having a curvature central point 33. The guide segment 32 comprises a second circular segment 32', whose curvature center point is also provided by the curvature central point 33. The guide segment 32 transitions into the bearing segment 31 via a transition segment 34, wherein the transition portion 34 is initially formed with a sharp curvature, then is curved less sharply, wherein the less sharply curved segment forms an abutment segment line, and then transitions into the bearing segment 31 via a slightly concave-curved shoulder segment.

On the side opposing the abutment segment 34', the guide segment 32 transitions into the insertion segment 35 via a slightly concave- or even a convex-curved segment 37; the insertion segment 35 is designed as a circular-segment shape with a larger curvature radius than the curvature radius of the first circular segment 31' and transitions into the bearing segment 31 via a convex-curved shoulder segment 38.

An eccentric shaft denoted as a whole with 40 is insertable into the eccentric opening 30; the eccentric shaft includes a middle bearing part 41, whose cross-section is adapted to the cross-section of the eccentric opening 30. As is apparent especially from FIG. 8, which shows in cross-section the bearing part 41 of the eccentric shaft 40 accommodated in the eccentric opening 30, the bearing part 41 of the eccentric shaft includes a bearing portion 42, whose outer contour is designed as a circular-segment shape with approximately the same radius as the radius of the first circular segment 31' of the eccentric opening 30. The bearing portion 42 transitions into a guide portion 43 via concave-curved lateral constrictions; the guide portion 43 has a curvature corresponding to the curvature of the second circular segment 32' in its portion opposing the circular-segment-shaped-curved portion of the bearing portion 42. An abutment portion 44, which is formed on a side of the bearing part 41 between the bearing portion 42 and the guide portion 43, abuts on the abutment segment 34' of the eccentric opening 30 in the illustrated position of the bearing part 41.

Figure 8:
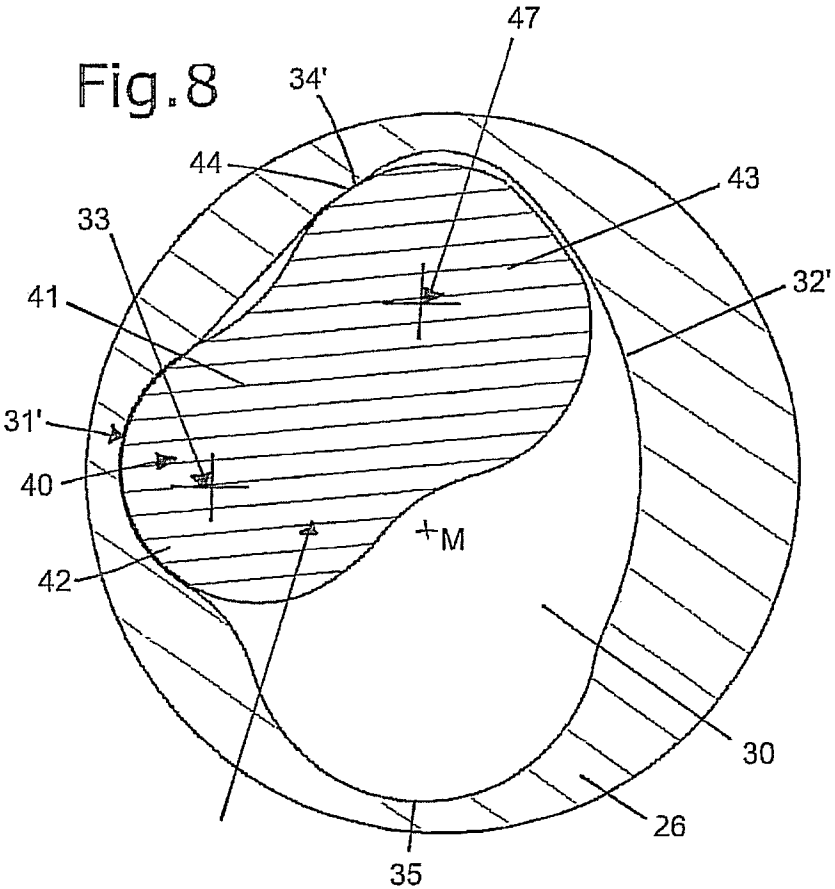
FIG. 8 shows the view of FIG. 7, with a cross-section of the cam shaft disposed in the eccentric opening.

The position of the bearing part 41 illustrated in FIG. 8 corresponds to the position of the bearing part 41 that is farthest rotated in the counter-clockwise direction. The bearing part 41 can be rotated from this position about the curvature central point 33 in the clockwise direction, wherein the bearing portion 42 is borne in the bearing segment 31 and the guide portion 43 at least proximally abuts on the second circular segment 32'.

The eccentric shaft 40 ends on both sides in bearing pins 46 that have a common axis denoted with 47 in FIG. 8. The terminal ends of the bearing pins 46 are provided with holes 48. A connecting lever 50 is rigidly connected with the eccentric shaft 40. The bearing part, the bearing pins and the connecting lever of the eccentric shaft 40 are advantageously constructed as a one-piece component.

A first follower roller 52 is bearable on the outer surface of the eccentric bearing body 26 between the side parts 22 of the valve lever 6.

Two follower rollers 56 are bearable on the bearing pins 46 of the eccentric shaft 40 with annular washers 54 disposed in between.

The kinematics of the described arrangement is advantageously such that the central point 47 and/or the axes of the bearing pins 46 move on a circular-segment-shaped path when the eccentric shaft 40 is reciprocally pivoted; the circular-segment-shaped path extends at least approximately through the central point 11 of the eccentric bearing body 26 that forms the rotational axis of the follower roller 52. As is directly apparent from FIGS. 7 and 8, the available space inside of the eccentric body is utilized effectively due to the position of the curvature central point 33 eccentric relative to the central point 11 which curvature central point 33 forms the bearing axis of the eccentric shaft 40 and defines the movement path of the guide portion 43 in a central portion of the eccentric bearing body 26.

The end portion 20 of the valve lever 6 is formed with hollow cylindrical bearing arms 58; torsion springs 60 are slidable onto the bearing arms 58. Bearing journals 62 are insertable into the bearing arms 58 and are formed on spring levers 64 that include projecting pins 46, which are insertable into the holes 48 formed at the terminal ends of the bearing pins 46 with a clearance.

A spacer sleeve 68 is slidable into and through the bearing journals 62. The spring levers 64 are pivotably attachable to the valve lever 6 using a rivet 70, whose shaft is slidable into and through the spacer sleeve 68. When the spring levers 64 are mounted on the valve lever 6, the torsion springs 60 are supported with each axial arm 72 on a side part 22 of the valve lever 6 and with each radial arm 74 on a bent lug 76. The spring lever 64 according to FIG. 4 is biased by the torsion springs 60 for rotation in the counter-clockwise direction relative to the valve lever 6 and thereby biasing the second follower roller 56 in the upward direction.

A locking mechanism accommodated in the passage opening 28 of the end portion 18 of the valve lever 6 comprises a locking pin 80, a spring 82, a guide journal 84, a retaining journal 86 and a retaining pin 88 insertable through the named components, which retaining pin 88 is affixable with a lock washer 90.

Figure 10:
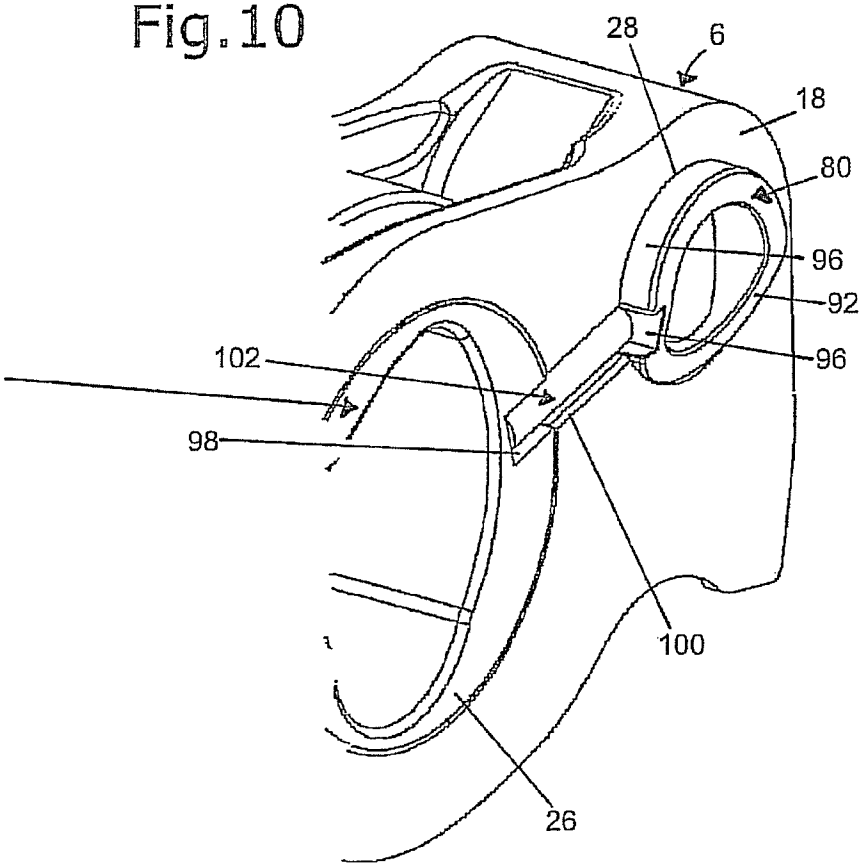
FIG. 10 shows a perspective view for explaining the functions of a locking pin.

As is apparent especially from FIG. 10, the front end of the locking pin 80 is formed with a bevel 92 that advantageously corresponds to a corresponding bevel of the front end of the connecting lever 50; the front, lower end portion of the connecting lever 50 includes an contact area 94, whose contour corresponds to the upper side 96 of the terminal end portion of the locking pin 80.

The outer circumference of the locking pin 80 is formed with a groove 96. Similarly, the outer circumference of the eccentric bearing body 26 is formed with a groove 98. The grooves 96 and 98 align with a groove 100 in a predetermined rotational position of the locking pin 80 and the eccentric bearing body 26; the groove 100 is laterally formed in the valve lever 6 and a locking pin 102 is accommodated therein; the locking pin 102 holds the locking pin 80 and the eccentric bearing body 26 so as to be not-pivotable relative to the valve lever 6. The locking pin 102 is accommodated in the groove and the grooves 96, 98 and 100, respectively, in a captive manner using a not-illustrated mechanism.

Figure 9:
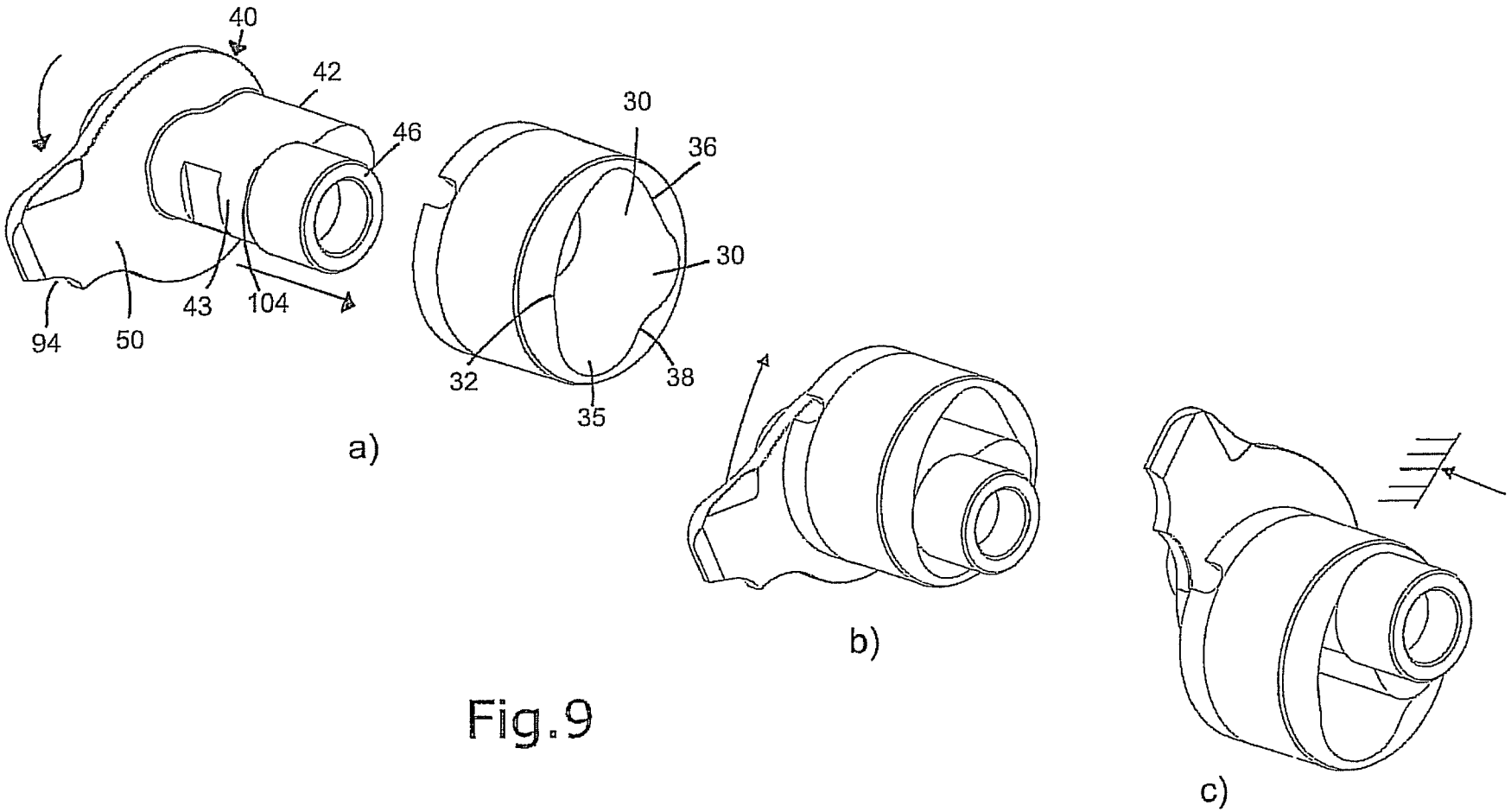
FIG. 9 shows a perspective illustration for explaining an assembly sequence.

The assembly of the valve lever assembly takes place, e.g., as follows:

As shown in FIG. 9, the eccentric shaft 40 is inserted into the eccentric opening 30 in a rotational position, in which the guide portion 43 arrives in the insertion segment 35. The bearing pin 46 can thereby be pushed through the insertion segment 35, which has a large curvature radius and is thus widened (FIG. 9*b*). When the eccentric shaft 40 is subsequently rotated in the counter-clockwise direction (FIG. 9*c*), a step 104 (FIG. 9*a*) formed between the guide segment 43 and the bearing pin 46 engages the edge of the eccentric opening 30 from below, so that the eccentric shaft 40 is held in an axially undisplaceable manner as a consequence of the connecting lever 50 and the step 104. From this position, the eccentric shaft 40 can be reciprocally rotated and/or pivoted inside of the eccentric opening 30. The rotational axis of the eccentric shaft 44, which extends through the curvature central point 33 (FIG. 8), is thus eccentric to the central axis of the eccentric bearing body 26, so that the bearing pin 46 with its axis 47 pivots upwards and downwards relative to the outer circumferential surface of the eccentric bearing body when the eccentric shaft 40 is reciprocally pivoted.

The assembly of the eccentric bearing body 26 and the eccentric shaft 40 is inserted into the opening 24 penetrating through the side parts 22, wherein the first follower roller 52 is previously inserted between the side parts 22; due to the insertion of the eccentric bearing body 26, the first follower roller 52 is borne on this eccentric bearing body 26. Subsequently, the annular washers 54 are slid onto the bearing pins. Thereafter, the second follower rollers 56 are slid onto the bearing pins 46. Subsequently, the torsion springs 60 are slid onto the bearing arms 58 and the spring arms 64 are attached and are pivotably affixed to the valve lever 6 using the spacer sleeve 68 and the rivet 70, whereby the two follower rollers 56 are held in a captive manner and are resiliently biased on the valve lever 6 in the upwards direction.

Figure 11:
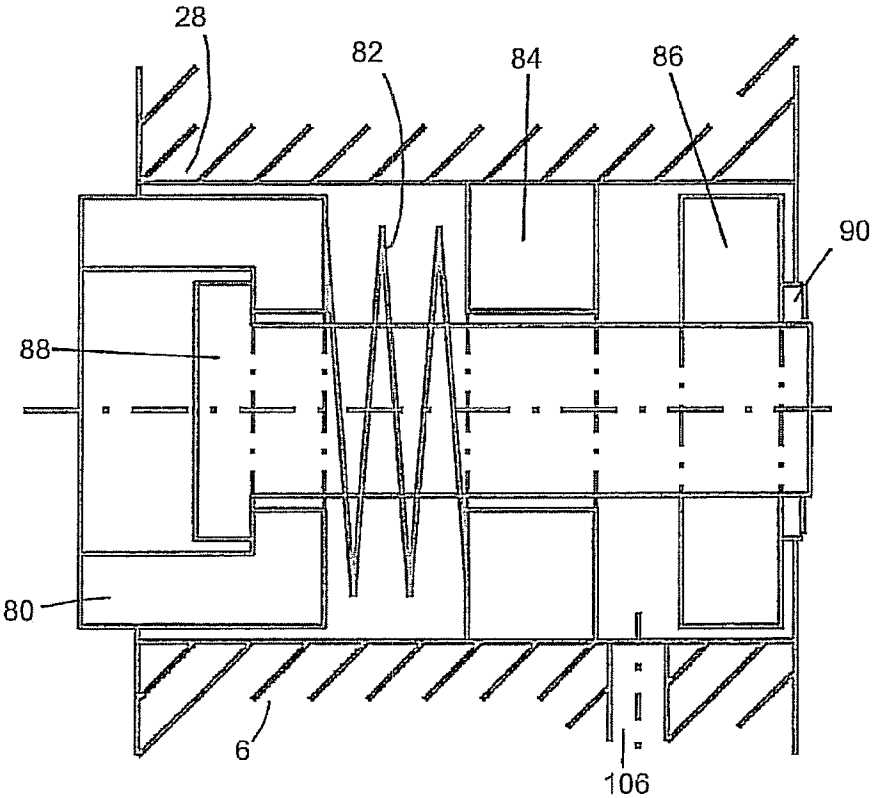
FIG. 11 shows a section through parts of the locking device disposed in the valve lever.

Subsequently, the locking mechanism shown in longitudinal section in FIG. 11 is installed. As shown in FIG. 11, a guide journal 84 is first inserted into the passage opening 28 of the end portion 18 of the valve lever 6 such that it is disposed left of a pressurized fluid supply channel 106 according to FIG. 11. The spring 82, the locking pin 80 and the retaining pin 88 are then inserted from the left. The retaining journal 86 is then affixed to the retaining pin 88 from the right using the lock washer 90. The function of the locking mechanism is such that, when the pressurized fluid supply channel 106 is not under pressure, the spring 82 presses the locking pin 80 out of the passage opening 28 and such that, when the pressurized fluid supply channel 106 is under pressure by building up pressure in the space between the guide journal 84, through which the retaining pin 88 is movably guided in a sealed manner, and the retaining journal 86, which is movably guided in the passage opening 28 in a sealed manner, the locking pin 80 is inwardly moved into the passage opening 28 against the force of the spring 82.

The function of the described valve lever assembly is as follows:

It is first assumed that the locking pin 80 is disposed inside of the passage opening 28 by application of pressure to the pressurized fluid supply channel 106, so that the spring lever 64 can reciprocally pivot together with the two follower rollers 56, wherein the spring levers 64, which engage with a clearance in the bearing pin 46 by means of the projecting pins 66, can pivot upwardly and downwardly together with the second follower rollers 56 and this reciprocal movement takes place in a low friction and well-defined way due to the bearing of the eccentric shaft 40 in the eccentric opening 30.

The second follower rollers 56 are continuously urged into abutment on the second cam 14 of the cam shaft 4 due to the biasing of the torsion springs 60, wherein the cam lift of the second cam 14 is not transmitted to the valve lever 6, because the second cams 14 can move upwardly and downwardly by pivoting of the spring lever and/or the eccentric shaft, without the valve lever following this movement. The valve lever 6 is thus actuated by the abutment of the first cam 12 on the first follower roller 52.

When the second follower rollers 56 abut on the base circle of the second cams 14 and thus are pivoted into their highest position, the contact area 94 of the connecting lever 50, which is rigidly connected with the eccentric shaft 44, is disposed directly above the passage opening 28, so that the locking pin 80 moves out of the passage opening 28 by releasing pressure from the pressurized fluid supply channel and a downward movement of the second follower rollers 56 relative to the valve lever 6 by further rotation of the second cam 14 is locked. The valve lever 6 is thus actuated according to the contour of the second cam 14 when the pivotability of the connecting lever 50 relative to the valve lever 6 is blocked. The actuation forces generated thereby are lead directly into the valve lever 6 from the bearing pin 46 in the bearing portion 42 of the eccentric shaft 40 and from there via the eccentric bearing body 26.

In case the locking pin 80 is already moved out of the passage opening 20 when the front portion of the connecting lever 50 is located underneath or in overlap with the locking pin 80, the connecting lever 50 can move the locking pin 80 against its bevel 92 and advantageously against the corresponding bevel of the connecting lever 50 back into the passage opening 28 during its upward movement, so that the terminal end of the connecting lever 50 upwardly moves until the contact area 94 moves directly over the locking pin 80 and this arrives outside of the passage opening 28 and the rotatability of the connecting lever 50 locks.

The exemplary-described and very compactly-build valve lever assembly can be modified in various ways. The valve lever 6 as well as the eccentric shaft 40 can be constructed as cast parts. The eccentric shaft can have only one bearing pin with an accompanying follower roller for following only one second cam, wherein the described embodiment has the advantage that the valve lever is symmetrically depressed. The rotationally-affixed arrangement of the eccentric bearing body 26 in the valve lever 6 can take place by means of a direct form-fit between a contour of the eccentric bearing body 26 and the valve lever 6. The follower rollers can be formed as follower surfaces that are directly formed on the bearing pins and/or the outer surface of the eccentric bearing body. The eccentric bearing body can then be omitted as its own component. The first follower surface can be directly formed on the valve lever, which is directly formed with the eccentric opening. The eccentric opening can be formed without the widened insertion segment.

The function of the connecting lever 50 can be undertaken by a spring lever, whose pivotability is locked by the locking mechanism.

Figure 12:
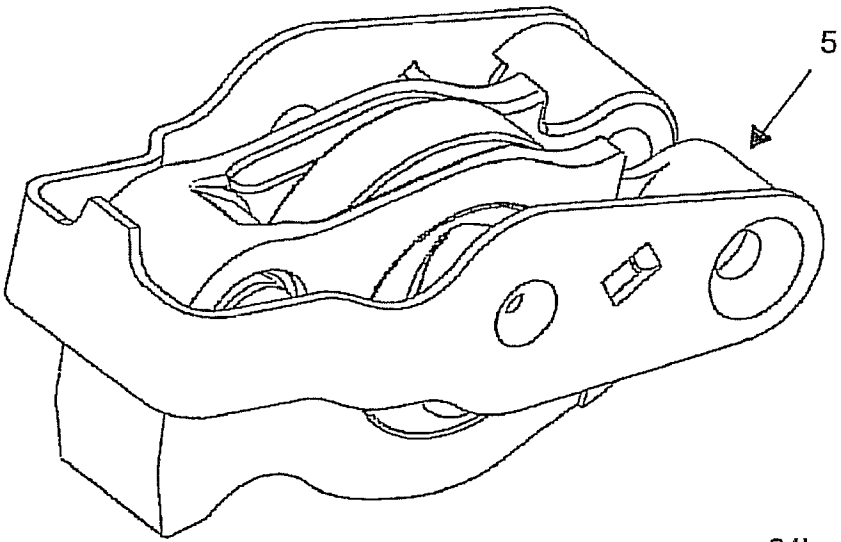
FIG. 12 shows a view similar to FIG. 1 of a modified embodiment of the actuating mechanism.
Figure 13:
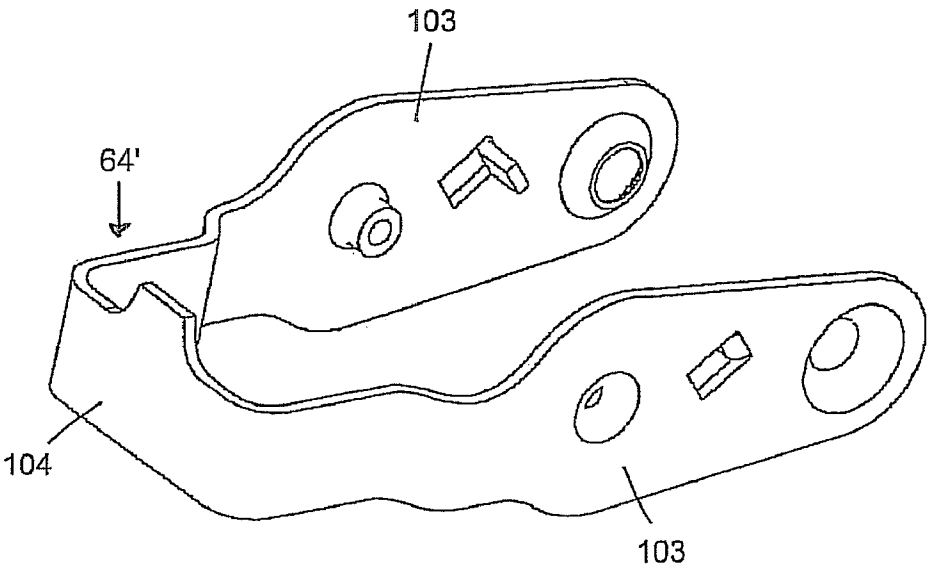
FIG. 13 shows a perspective view of a spring lever.

FIGS. 12 and 13 show an embodiment of the valve lever assembly 5, in which the two spring levers 64 of the embodiment shown in FIG. 4 are combined into one overall U-shaped spring lever 64' that can be formed as a sheet metal part. As is apparent, the embodiment of FIGS. 12 and 13 differs from the embodiment of FIG. 4 in that the individual spring levers 64 of FIG. 4 form arms 108 of the U, which are connected via a bridge 110. In the embodiment of the spring lever of FIG. 12, the locking pin 80, which is movable out of the valve lever 6, can be, e.g., moved into a corresponding recess of the spring lever in the portion between the bridge 110 and the arms 108 or can come into abutment on a corresponding abutment surface.

REFERENCE NUMBER LIST

2 Charge changing lever
4 Cam shaft
5 Valve lever assembly
6 Valve lever
9 Valve play-compensation element
12 First cam
14 Second cam
16 Closing spring
18 End portion
20 End portion
22 Side part
24 Opening
26 Eccentric bearing body
28 Passage opening
30 Eccentric opening
31 Concave bearing segment
31' First circular segment
32 Concave guide segment
32' Second circular segment
33 Curvature central point
34 Transition segment
34' Abutment segment
36 Shoulder segment
37 Segment
38 Shoulder segment
40 Eccentric shaft
41 Bearing part
42 Bearing portion
43 Guide portion
44 Abutment portion
46 Bearing pin
47 Axis
48 Hole
50 Connecting lever
52 Follower roller
54 Annular washer
56 Second follower roller
58 Bearing arm
60 Torsion spring

62 Bearing journal
64 Spring lever
64' Spring lever
66 Projecting pin
68 Spacer sleeve
70 Rivet
72 Axial arm
74 Radial arm
76 Lug
80 Locking pin
82 Spring
84 Guide journal
86 Retainer journal
88 Retainer pin
90 Lock washer
92 Bevel
94 Contact area
96 Groove
98 Groove
100 Groove
102 Locking pin
104 Step
106 Pressurized fluid supply channel
108 Arm
110 Bridge

We claim:

1. A valve lever assembly having a switchable valve actuating mechanism for acting in combination with a camshaft having a first cam and at least one second cam, which is higher than the first cam, which valve assembly comprises a first follower surface for following the first cam, at least one second follower surface for following the second cam and a valve lever, which is supported on an engine-affixed component and on the to-be-actuated valve, wherein the second follower surface is rotatable relative to the first follower surface by an eccentric device borne on the valve lever, and a locking mechanism, with which the rotatability of the eccentric device is lockable, wherein when the eccentric device is freely rotatable, the first follower surface actuates the valve in accordance with the contour of the first cam and when the rotatability of the eccentric shaft is locked, the second follower surface actuates the valve in accordance with the contour of the second cam, and wherein the eccentric device comprises an eccentric opening, which penetrates transversely through the valve lever and is fixed relative to the valve lever to as to rotate therewith, and an eccentric shaft rotatably borne in the eccentric opening, the eccentric shaft defining the position of the second follower surface.

2. A valve lever assembly according to claim 1, wherein the eccentric opening has a cross-sectional profile with a concave bearing segment that is opposite to a concave guide segment, which is less sharply curved than the bearing segment, and the eccentric shaft includes a bearing portion in a bearing part of the eccentric shaft, which eccentric shaft is accommodated in the eccentric opening, the outer contour of the bearing portion being adapted to that of the bearing segment, and the eccentric shaft also includes a guide portion, whose outer contour is adapted to the guide segment so that the eccentric shaft is reciprocally rotatable in the eccentric opening while rotating in the bearing segment and while being guided along the guide segment.

3. A valve lever assembly according to claim 2, wherein the bearing segment includes a first circular segment having a first curvature of radius and the guide segment includes a second circular segment having a second curvature of radius, which is larger than the first curvature of radius, and the two circular segments have a common curvature center point, through which the eccentric shaft extends.

4. A valve lever assembly according to claim 3, wherein the cross-sectional profile of the bearing portion includes a portion corresponding to the first circular segment.

5. A valve lever assembly according to claim 3, wherein the cross-sectional profile of the guide portion includes a portion corresponding to the second circular segment.

6. A valve lever assembly according to claim 2, wherein an abutment segment is formed in a transition segment between the guide segment and the bearing segment, the abutment segment limiting the rotatability of the eccentric shaft.

7. A valve lever assembly according to claim 6, wherein a segment of the eccentric opening that is opposite to the abutment segment widens as an insertion segment such that the eccentric shaft is slidable into the eccentric opening in a rotational position relative to the eccentric opening, in which the bearing portion is facing towards the abutment segment, and from this rotational position is rotatable into a rotational position, in which the bearing portion is accommodated in the bearing segment and the guide portion comes into abutment on the guide segment.

8. A valve lever assembly according to claim 1, wherein the eccentric opening is formed in an eccentric bearing body disposed in the valve lever so as to rotate therewith.

9. A valve lever assembly according to claim 8, wherein the first follower surface is formed by the circumferential surface of a follower roller borne on the eccentric bearing body.

10. A valve lever assembly according to claim 1, wherein the eccentric shaft includes a pin defining the position of the second follower component axially adjacent to the bearing of the eccentric shaft in the eccentric opening, the eccentric shaft being elastically biased in the direction of abutment of the second follower surface on the second cam and being lockable by the locking mechanism when the second follower surface abuts on the base circle of the second cam.

11. A valve lever assembly according to claim 10, wherein the second follower surface is formed by the circumferential surface of a follower roller borne on the pin.

12. A valve lever assembly according to claim 1, wherein the locking mechanism includes a connecting lever connected with the eccentric shaft so as to rotate therewith, the position of the connecting lever being lockable relative to the valve lever when the second follower surface abuts on the base circle of the second cam.

13. A valve lever assembly according to claim 11, wherein the eccentric shaft is integrally formed with the connecting lever and the pin.

14. A valve lever assembly according to claim 11, wherein a locking component is mounted on the valve lever, the locking component being reciprocally movable between a position locking the rotatability of the connecting lever and a position permitting the pivotability.

15. A valve lever assembly according to claim 14, wherein the locking component is formed as a locking pin, which is displaceable by hydraulic pressure against the force of a spring.

16. A valve lever assembly according to claim 1, wherein a spring lever is borne on the valve lever, which spring lever is in engagement with the eccentric shaft and is biased by a spring supported between the valve lever and the spring lever such that the second follower surface is biased in the direction of abutment on the second cam.

17. A valve lever assembly according to claim 1, wherein a second follower surface is formed on both sides of the bearing of the eccentric shaft in the eccentric opening, the respective second follower surfaces acting in combination with the respective second cams.

18. A valve lever assembly according to claims 1, wherein the engine-affixed component, on which the valve lever is supported, is formed as a hydraulic valve play-compensation element, through which the locking mechanism is actuatable by hydraulic pressure.

* * * * *